US005974777A

United States Patent [19]

Davis

[11] Patent Number: 5,974,777

[45] Date of Patent: Nov. 2, 1999

[54] YARN TEXTURIZER COOLING DRUM

[76] Inventor: David M Davis, 210 Lees Chappel Rd., Tunnel Hill, Ga. 30755

[21] Appl. No.: 09/063,606

[22] Filed: Apr. 21, 1998

[51] Int. Cl.[6] ..... D01H 7/46

[52] U.S. Cl. ..... 57/290; 57/252; 57/308; 28/255; 28/256; 28/266

[58] Field of Search ..... 57/252, 290, 308; 28/247, 248, 249, 250, 254, 255, 256, 257, 266

[56] References Cited

U.S. PATENT DOCUMENTS 4,118,843 10/1978 Schippers et al. ..... 28/255
4,301,578 11/1981 Dammann et al. ..... 28/256

FOREIGN PATENT DOCUMENTS 47-21268 6/1972 Japan ..... 28/257
1054456 11/1983 U.S.S.R. ..... 28/266

*Primary Examiner*—William Stryjewski
*Assistant Examiner*—Gina Silverio
*Attorney, Agent, or Firm*—Alan Ruderman; Miller & Martin

[57] ABSTRACT

A rotatable yarn cooling drum for cooling yarn plugs emanating from two texturizers has a circumferential perforated shell about which the yarn plugs are wound and cooled. A deflector in the form of a finger is spaced radially from the surface of the shell and laterally positioned between the ends of the shell. A yarn guide radially spaced from the drum has two yarn guide grooves for guiding the yarn plugs onto the shell at one side of the deflector and one lateral end of the shell. The yarn plugs may thus enter onto the shell at one lateral end and exit at the other lateral end after making more than a complete turn on the drum. The guide slots are illustrated as formed in a block to which the finger is attached.

14 Claims, 2 Drawing Sheets

YARN TEXTURIZER COOLING DRUM

BACKGROUND OF THE INVENTION

This invention relates to a yarn texturizer cooling drum and more particularly to a cooling drum which may receive yarn plugs from at least two texturizers and permit the plugs to be wrapped more than once about the drum.

In the manufacturing of yarn from synthetic plastic, the yarn is extruded and thereafter sent to a texturizer which blows air onto it to increase its bulk. The process includes a texturizing nozzle wherein air or similar fluid under high velocity impinges on the yarn to crimp and compress the yarn into a yarn plug. After the yarn leaves the texturizer apparatus it passes over a cooling drum. There the plug is cooled and as the plug leaves the cooling drum the yarn is placed under tension and is unraveled from the plug so that it may be wound upon a cone or spool for subsequent use in textile product manufacture.

The longer the yarn can stay on the drum the more it is cooled and the less it will later be reduced in diener as it is fed by the tension creating feed rollers and unraveled. The yarn plug leaving a single texturizer may make a plurality of wraps or turns about a cooling drum as is disclosed in Dammann U.S. Pat. No. 4,301,578 and Irvine U.S. Pat. No. 4,908,919. However, wherein one cooling drum is utilized for cooling plugs from more than one texturizer, the prior art drum apparatus does not permit more than a single partial turn about the drum, since in these texturizing systems the yarn leaves the drum approximately 270 degrees from where the yarn plugs enter the drum. In the known prior art cooling drums which receive yarn plugs from two texturizers, the drum has a separate groove formed for each yarn plug, and therefore wrapping the yarn plug about the drum more than once is not possible. Accordingly, the yarn cooling that occurs on such drums is less than desirable and the yarn when withdrawn is stretched and reduced in diener an amount greater than desirable.

SUMMARY OF THE INVENTION

Consequently, it is a primary object of the present invention to provide a cooling drum for yarn texturizing apparatus wherein yarn from more than one texturizer may be cooled by making more than one complete wrap about the drum.

It is another object of the present invention to provide a yarn texturizing cooling drum for use with more than one texturizer wherein a yarn plug from each texturizer may be maintained longer on the drum cooling surface than heretofore possible in the prior art.

It is a further object of the present invention to provide a rotatable yarn cooling drum for yarn texturizing apparatus, the drum having a single cooling groove and a separate guide for guiding yarn from each texturizer toward a first segment of said groove, and a deflector disposed for deflecting and ensuring that the yarn exiting the guides enter onto said first segment while permitting the yarn to be wrapped onto the remainder of said drum cooling groove.

It is a still further object of the present invention to provide a rotatable yarn texturizing cooling drum for use with more than one texturizer, the drum having a perforated circumferential cooling groove, a deflector mounted for dividing the groove into a pair of axially spaced segments adjacent a yarn plug entrance location, and a separate yarn guide disposed adjacent said plug entrance location for guiding a yarn plug from said texturizers to one of said segments of said groove, said deflector precluding yarn plugs from entering onto the other segment of said groove.

Accordingly, the present invention provides a rotatable yarn cooling drum for use with yarn plugs emanating from at least two texturizers, the drum having a circumferential perforated surface forming a cooling groove through which a fluid cooling medium may flow, a deflector spaced from the cooling groove is mounted for deflecting the plugs so that the plugs may enter onto a first of two axially spaced segments of the groove, and a yarn guide for guiding each yarn plug onto the first segment of the groove, whereby the yarn enters onto the first segment and may be wrapped onto and exit the second segment.

The deflector and the yarn guides respectively may be mounted on and formed in a common mounting member spaced radially from the surface of the drum.

Alternatively, the deflector and yarn guides may be supported on or carried by separate mounting members spaced from the surface of the drum. In any event, the yarn plugs may enter onto the first segment of the cooling groove, make a partial wrap onto the second segment and thereafter wrap about the second segment so that an additional wrap about the cooling surface relative to the prior art may occur.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
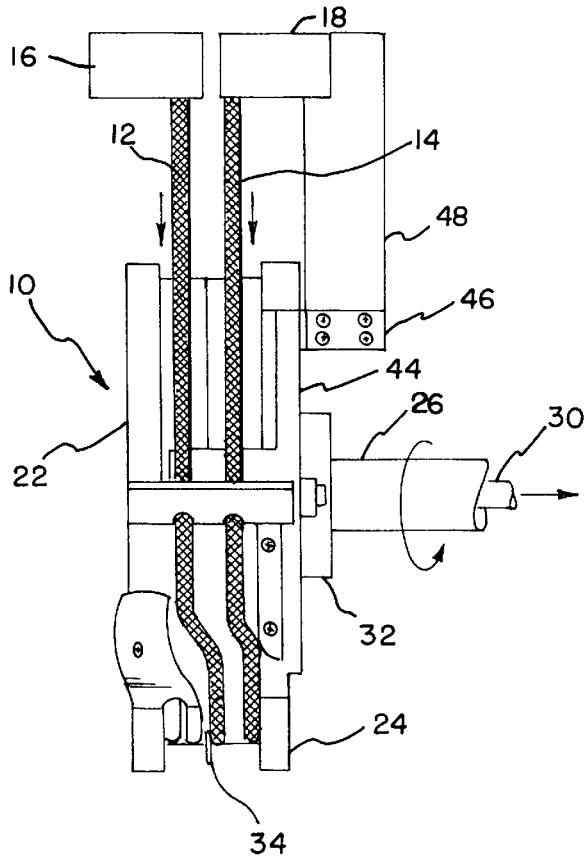
FIG. 1 is a top plan view with portions thereof partly broken away and partly diagrammatic illustrating a cooling drum of the present invention illustrating yarn plugs fed from two texturizers.
Figure 2:
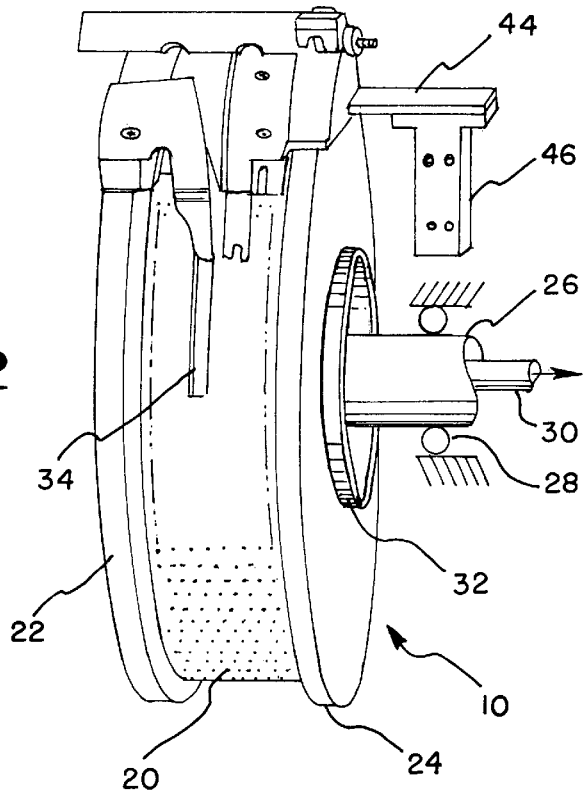
FIG. 2 is a perspective view of the cooling drum of the present invention.

Referring now to the drawings, FIG. 1 illustrates a cooling drum of the present invention generally indicated at 10 receiving two yarn plugs 12, 14 from respective texturizer apparatus, illustrated diagrammatically, which may be the stuffer box such as in the aforesaid U.S. Pat. No. 4,301,578 or a texturizing nozzle such as in U.S. Pat. No. 5,653,010, or any other apparatus which creates a bulk increasing plug of yarn as the yarn is fed from the forming apparatus such as a synthetic yarn extruder or similar synthetic filament producing equipment. The drum 10 has a hollow interior about which there is an annular apertural or perforated sheet 20 forming a hollow shell or a plug carrying groove between a pair of spaced apart flanges 22, 24 of the drum. The drum 10 has an inner hub (not illustrated) which is fastened to a shaft 26 supported by bearings 28, the shaft being rotatably driven at a relatively low speed either by separate drive apparatus or from drive apparatus of the texturizer as is well known in the art. The shaft 26 may be hollow and a subatmospheric pressure is created within the hollow interior of the drum by means of a suction pipe 30 extending through the shaft 26 and connected to the suction side of a conventional shop air source. Alternatively, the suction side of the compressor may be coupled to a rim 32 of the drum 10. The low pressure within the hollow drum results in ambient air being drawn through the perforations of the shell 20 into the hollow where it is pulled by the suction pipe. As the air flows through the perforations, the plugs mounted thereon are cooled. It thus may be seen that increasing the time that the plugs are maintained on the surface of the perforated sheet increases the amount of cooling.

Although not illustrated, after the plugs leave the drum they are pulled and unraveled into respective strands of yarn. As aforesaid, the longer the yarn plugs remain on the shell of the drum, the greater the cooling of the plugs and the less the strands will be reduced in diener as they are pulled. In the prior art when yarn plugs have been fed to a single drum from more than one texturizer the yarn plugs entered and left the perforated shell 20 in one turn or less, the yarn leaving the drum spaced angularly from the location where it left the drum. Accordingly, the amount of cooling of the yarn plugs has been less than desirable. For example, in the case of yarn from two texturizers, the surface of the perforated shell 20 was divided by a ridge or wall into two circumferential sections each effectively forming a groove with the ridge therebetween. Yarn from each texturizer could only be wrapped about the sheet in a respective groove since the ridge prevented yarn in one section from entering the other section.

In accordance with the present invention, the perforated shell 20 is not divided into sections by a ridge or wall, but the drum has only a single groove or section while yarn guides for guiding the yarn from the texturizers toward one circumferential portion or segment of the groove or surface of the perforated shell is provided and a deflector is mounted for deflecting the plugs leaving the guides so that the yarn plugs enter onto but a single or first segment of the groove while precluding the plugs from entering the remainder or second segment of the groove. The yarn which enters onto the first segment of the groove then may be wrapped onto the second segment of the groove and thereafter exit the drum at the second segment.

Figure 3:
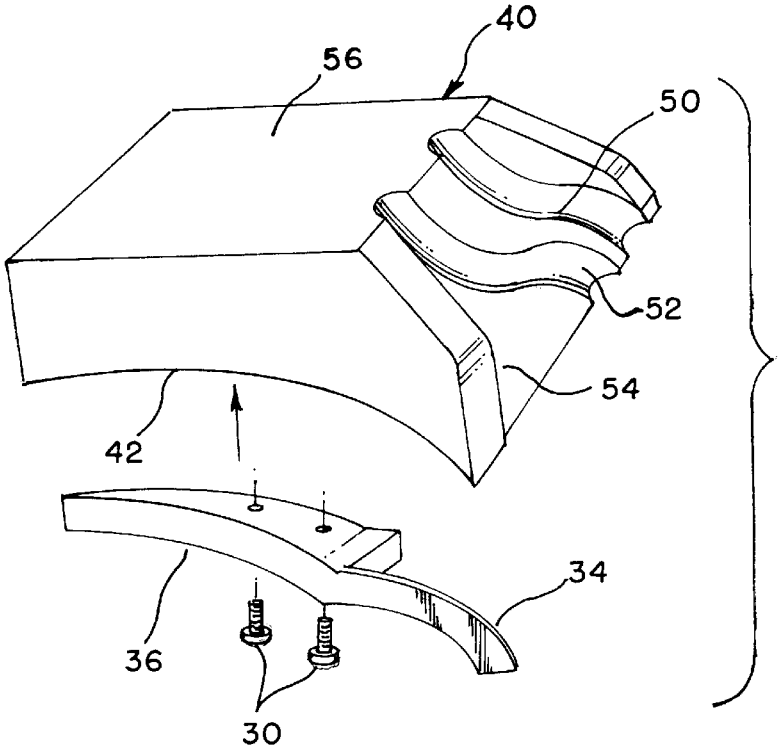
FIG. 3 is a perspective exploded view of yarn guide apparatus and a yarn deflector constructed in accordance with a preferred embodiment of the present invention.

In the preferred embodiment illustrated, wherein yarn plugs are received from two texturizers, the deflector, as illustrated in FIG. 3, is in the form of a finger 34 which may be fastened to a support plate 36 by rivets, screws or other fasteners. The finger 34 may have an arcuate shape which is of a length equivalent to a small arc of the shell 20. The support plate 36 may in turn be fastened by screws 38 or the like to a foot 40 having an arcuate bottom or lower contour 42 conforming substantially to the configuration of a cylindrical arc of the perforated shell 20, but of a slightly larger diameter. The foot 40, which preferably comprises a metal block, may have a bracket 44 extending from a side thereof at the rear, the bracket 44 being secured to an attachment bracket 46 adapted for attachment to a mounting portion 48 of the texturizer apparatus. Thus, the foot 40 may be mounted in spaced relationship a small amount above the surface of the perforated shell 20 of the drum thereby permitting the drum to rotate without interference from the foot while the finger 34 is disposed above the surface of the shell 20 and centrally disposed between the flanges 22, 24. The finger 34 thereby divides the shell of the drum, at least a small portion thereof, into two circumferencial segments, one on each lateral side of the deflecting finger 34. Alternatively, the finger may be mounted on a bar or rod or a portion of the texturizer apparatus rather than on the foot.

Figure 4:
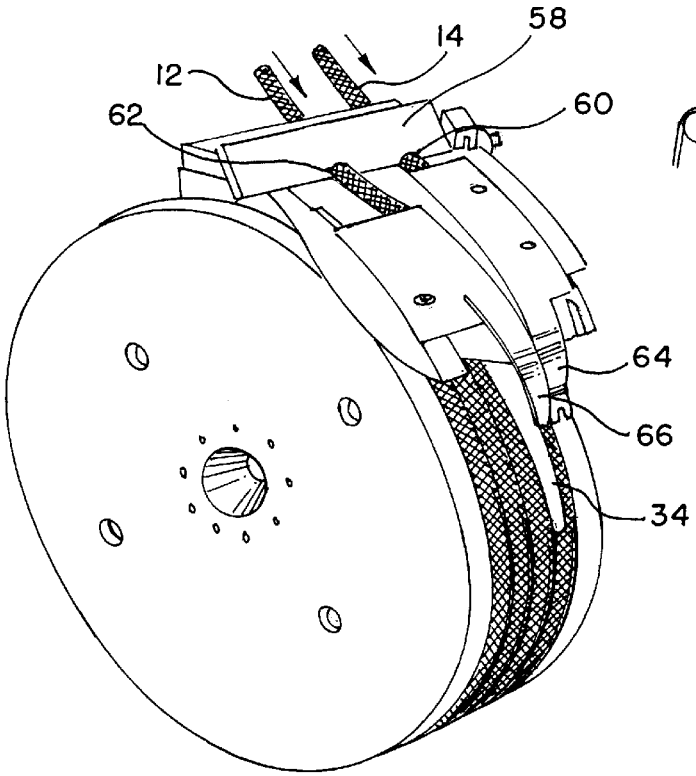
FIG. 4 is a perspective view taken from the opposite side of FIG. 2 and illustrating yarn plugs wrapped about the cooling drum.

The foot 40 includes a yarn guide slot corresponding to each respective texturizer. Thus, there are two such slots 50, 52 illustrated formed in a sloped surface 54 between the top surface 56 and the lower surface 42, one slot corresponding to each texturizer 16, 18. The guide slots, rather than being formed in the foot, may merely be yarn guide tubes and yet function in the same manner as the slots. In any event, the yarn plugs from the texturizer must be guided to one lateral side of the deflecting finger 34 so as to enter onto one lateral segment of the sheet 20. To this end if one of the slots 50, 52 is straight, the other must have a contour since the texturizer apparatus are separated further apart than the spacing between the guide slots. Thus, the slot 50 extends straight from the texturizer 18 while the slot 52 serpentines slightly as illustrated in FIGS. 1 and 3 and receives yarn from the texturizer 16. Also mounted adjacent the top of the foot 40 on the sloped surface 54 may be a hold-down guide 58 having guide apertures 60, 62 so as to direct the plugs from the texturizer into the guide slots 50, 52. Hold-down members 64, 66 are illustrated, but have been found not to be necessary to hold the plugs on the surface of the shell 20 at the left side of the drum illustrated in FIG. 4, that being the entry side of the plugs, i.e., the side on which the first segment is located.

The yarn plugs may thus enter the shell 20 on the first segment at the left side of the deflector 34, as illustrated, and prevented by the deflector from entering onto the right side of the shell at the exit of the guide. As they are wound further onto the shell 20 they cross over to the second segment of the shell below the deflector to the right side of the deflector at approximately the same angle of the drum from which they originally entered. Thereafter they are driven while on the second segment until they exit the second segment at approximately 270 degrees relative to the entry point on the first segment. They may thereafter be unraveled into yarn strands. The yarn plugs thus are disposed for cooling on the shell 20 for more than twice the time plugs were on the shell in the prior art.

Figure 5:
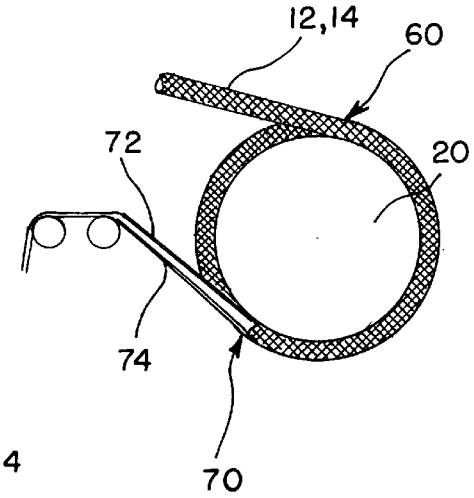
FIG. 5 is a diagrammatic view of the travel of the yarn with the apparatus of the present invention.

As illustrated in FIG. 5, in the prior art the plugs 12, 14 entering onto the drum at the entry location 68 would leave at the exit location 70 after making less than a full turn about the shell 20 of the drum, but with the apparatus of the present invention the plugs 12, 14 entering at 68 make a complete loop or turn on the shell and then loop again to the exit location at 70, the plugs being shifted from one side of the deflector 34 to the other side in the process. Thus, the present invention provides more than one additional loop or turn about the shell. It may therefore be seen that the plugs make a 360 degree turn plus approximately an additional 270 degree turn. In FIG. 5, the plugs are unraveled at the exit location so that two separate yarn strands 72, 74 are illustrated.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A rotatable yarn cooling drum for cooling yarn plugs emanating from at least two texturizers, said drum including a hollow annular cylindrical shell having a surface with perforations communicating with the hollow so that ambient air may be drawn through the perforations into the hollow when a sub-atmospheric pressure is applied to the hollow, said shell comprising a finite length formed between a pair of spaced apart lateral ends, a deflector having two sides spaced radially from the surface of said shell and disposed intermediate said lateral ends to define first and second segments of said shell, said first segment of said shell being located on one side of said deflector and said second segment of said shell being located on the other side of said deflector, and a yarn guide having an inlet and an exit for guiding a yarn plug from each of said texturizers onto said first segment of the surface of said shell at said exit of said guide, said deflector being located adjacent said exit, whereby said yarn plugs enter onto said first segment and are wound onto said second segment and exit from said shell after making more than one complete turn about said shell.

2. A cooling drum as recited in claim 1, wherein each yarn guide comprises a slot formed in a support foot, said slots having a configuration for directing said plugs toward said first segment.

3. A cooling drum as recited in claim 2, wherein said deflector comprises a finger having an arcuate configuration conforming substantially to the configuration of the surface of said shell.

4. A cooling drum as recited in claim 3, wherein said finger is carried by said support foot.

5. A cooling drum as recited in claim 2, wherein at least one of said slots has a serpentine configuration.

6. A cooling drum as recited in claim 5, wherein said deflector comprises a finger having an arcuate configuration and conforming substantially to the configuration of the surface of said shell.

7. A cooling drum as recited in claim 6, wherein said finger is carried by said support foot.

8. A rotatable yarn cooling drum for cooling yarn plugs emanating from at least two texturizers, said drum including a hollow annular cylindrical shell having a surface with perforations communicating with the hollow so that ambient air may be drawn through the perforations into the hollow when a sub-atmospheric pressure is applied to the hollow, said shell comprising a finite length formed between a pair of spaced apart lateral ends, a deflector comprising a finger having an arcuate configuration conforming substantially to the configuration of the surface of said shell, and said deflector spaced radially from the surface of said shell and disposed intermediate said lateral ends to define first and second segments of said shell, and a yarn guide having an inlet and an exit for guiding a yarn plug from each of said texturizers onto said first segment of the surface of said shell at said exit of said guide, said deflector being located adjacent said exit, whereby said yarn plugs enter onto said first segment and are wound onto said second segment and exit from said shell after making more than one complete turn about said shell.

9. A rotatable yarn cooling drum for cooling yarn plugs emanating from two texturizers, said drum including a hollow annular cylindrical shell having a surface with perforations communicating with the hollow so that ambient air may be drawn through the perforations into the hollow when a sub-atmospheric pressure is applied to the hollow, said shell comprising a finite length formed between a pair of spaced apart lateral ends, a deflector having two sides spaced radially from the surface of said shell and disposed intermediate said lateral ends to define first and second segments of said shell and a yarn guide having an inlet and an exit for guiding a yarn plug from each of said texturizers onto said first segment of the surface of said shell at said exit of said guide, said deflector being located adjacent said exit, said first segment of said shell being located on one side of said deflector and said second segment of said shell being located on the other side of said deflector, whereby said yarn plugs enter onto said first segment and are wound onto said second segment and exit from said shell after making more than one complete turn about said shell.

10. A cooling drum as recited in claim 9, werein said deflector comprises a finger having an arcuate configuration conforming substantially to the configuration of the surface of said shell.

11. A cooling drum as recited in claim 9, wherein each yarn guide comprises a slot formed in a support foot, one of said slots having a serpentine configuration so that both plugs may be directed toward said first segment.

12. A cooling drum as recited in claim 11, wherein said deflector comprises a finger having an arcuate configuration conforming substantially to the configuration of the surface of said shell.

13. A cooling drum as recited in claim 12, wherein said finger is carried by said support foot.

14. A cooling drum as recited in claim 9, wherein said deflector has a finite arcuate length extending a portion of the arc of said shell.

* * * * *